US006406024B1

(12) United States Patent
Perkins

(10) Patent No.: US 6,406,024 B1
(45) Date of Patent: Jun. 18, 2002

(54) IN-BETWEEN CARD GAME AND METHOD OF PLAYING

(76) Inventor: Thomas Francis Perkins, 6460 Chickasaw Dr., Douglasville, GA (US) 30135-4616

( * ) Notice: Subject to any disclaimer, the term of this patent is extended or adjusted under 35 U.S.C. 154(b) by 0 days.

(21) Appl. No.: 09/679,811

(22) Filed: Oct. 5, 2000

Related U.S. Application Data

(60) Provisional application No. 60/157,789, filed on Oct. 5, 1999, and provisional application No. 60/181,213, filed on Feb. 9, 2000.

(51) Int. Cl.[7] ..... A63F 1/00

(52) U.S. Cl. ..... 273/292; 273/274

(58) Field of Search ..... 273/292, 274, 273/309; 463/12, 13

(56) References Cited

U.S. PATENT DOCUMENTS 4,651,997 A * 3/1987 Wood ..... 273/292
5,377,993 A * 1/1995 Josephs ..... 273/292
5,685,774 A * 11/1997 Webb ..... 463/13
6,012,719 A * 1/2000 Webb ..... 273/292

* cited by examiner

*Primary Examiner*—Benjamin H. Layno
(74) *Attorney, Agent, or Firm*—Piper Rudnick LLP; Wilburn L. Chesser

(57) ABSTRACT

A three card game and method of playing that includes two rounds. The game is playable by one to seven players using one or more standard decks of 52 cards or representations thereof. The game is playable on a gaming table by players and a dealer, or on a computer or other electronic medium using representations of the various features. After payment of an ante by each player electing to play, three cards are dealt face up to each player in turn, and three cards are dealt face down to the dealer. After receiving the first card, each player optionally places a "first play" bet, the "first play" bet optionally being at odds depending on the first card received, and after receiving the second card, each player either "folds," losing the ante, or places a "second play" bet. Players are able to play in the first round, the second round, or both rounds. The dealer's cards are revealed after dealing is complete. Each player wins the first round if the third card dealt falls between the first two dealt. For the second round, the dealer's cards are compared to each player's cards, with the high hand winning. If the player's hand wins, the house pays a return based on a pay table. Betting minimums and maximums, and pay table odds are variably determined depending on mathematical probabilities and preferable odds selected by the house. In play with a gaming table, the table includes various locations for easing play and ensuring proper play, including locations for the in between card, ante, and wagers.

20 Claims, 9 Drawing Sheets

2Play Poker Between-Bet; Colorado version
Version where Ace is either high or low

| Player Card | Wins | Losses | RowSum | WinProb | Exp. Prof. | Odds Pay |
|---|---|---|---|---|---|---|
| 2 | 1056 | 1494 | 2550 | 0.414118 | 0.00% | 1 |
| 3 | 896 | 1654 | 2550 | 0.351373 | 0.00% | 1 |
| 4 | 768 | 1782 | 2550 | 0.301176 | 0.00% | 2 |
| 5 | 672 | 1878 | 2550 | 0.263529 | 0.00% | 2 |
| 6 | 608 | 1942 | 2550 | 0.238431 | 0.00% | 3 |
| 7 | 576 | 1974 | 2550 | 0.225882 | 0.00% | 3 |
| 8 | 576 | 1974 | 2550 | 0.225882 | 0.00% | 3 |
| 9 | 608 | 1942 | 2550 | 0.238431 | 0.00% | 3 |
| T | 672 | 1878 | 2550 | 0.263529 | 0.00% | 2 |
| J | 768 | 1782 | 2550 | 0.301176 | 0.00% | 2 |
| Q | 896 | 1654 | 2550 | 0.351373 | 0.00% | 1 |
| K | 1056 | 1494 | 2550 | 0.414118 | 0.00% | 1 |
| A | 2256 | 294 | 2550 | 0.884706 | 76.94% | 1 |
| ColSum | 11408 | 21742 | 33150 | 0.344133 | 5.92% | |

FIG.6A

2Play Poker Between-Bet; Colorado version
Version where Ace is high only

Pay = 1

| Player Card | Wins | Losses | RowSum | WinProb | Exp. Prof. | Odds Pay |
|---|---|---|---|---|---|---|
| 2 | 1056 | 1494 | 2550 | 0.414117647 | 0.00% | 1 |
| 3 | 880 | 1670 | 2550 | 0.345098039 | 0.00% | 1 |
| 4 | 736 | 1814 | 2550 | 0.288627451 | 0.00% | 2 |
| 5 | 624 | 1926 | 2550 | 0.244705882 | 0.00% | 3 |
| 6 | 544 | 2006 | 2550 | 0.213333333 | 0.00% | 3 |
| 7 | 496 | 2054 | 2550 | 0.194509804 | 0.00% | 4 |
| 8 | 480 | 2070 | 2550 | 0.188235294 | 0.00% | 4 |
| 9 | 496 | 2054 | 2550 | 0.194509804 | 0.00% | 4 |
| T | 544 | 2006 | 2550 | 0.213333333 | 0.00% | 3 |
| J | 624 | 1926 | 2550 | 0.244705882 | 0.00% | 3 |
| Q | 736 | 1814 | 2550 | 0.288627451 | 0.00% | 2 |
| K | 880 | 1670 | 2550 | 0.345098039 | 0.00% | 1 |
| A | 1056 | 1494 | 2550 | 0.414117647 | 0.00% | 1 |
| ColSum | 9152 | 23998 | 33150 | 0.276078431 | 0.00% | |

FIG.6B

IN-BETWEEN CARD GAME AND METHOD OF PLAYING

This application claims priority to applicant's copending U.S. Provisional Patent Application Ser. No. 60/157,789 of Thomas Francis PERKINS titled "IN-BETWEEN CARD GAME AND METHOD OF PLAYING" filed Oct. 5, 1999, and copending U.S. Provisional Application Ser. No. 60/181,213 of Thomas Francis PERKINS titled "IN-BETWEEN CARD GAME AND METHOD OF PLAYING" filed Feb. 9, 2000.

FIELD OF THE INVENTION

This invention relates to a game, and in particular to a two-round casino-style game played with at least one standard deck of cards, the game including a first round having an in-between feature played with three cards and a second round played with the same three cards in accordance with the rules of poker and use of a pay table.

BACKGROUND

It is known in the art to provide single round three card games, such as games for play on gaming tables at casinos. These known three card games include games such as "Three Card Poker." Typical three card games, however, besides having only one round, include other features that discourage play or decrease players' incentive to play. For example, these games may prohibit players from winning if the dealer's hand is disqualified—the dealer's hand may have to have a rank of one jack or higher or one ace or higher, for example, in order for the players to have the opportunity to obtain a return on their bets. Failure of the dealer to qualify with such hands results in all of the players returning their cards, with no opportunity to win with the cards the players were dealt. Thus, a player making a large bet based on a good hand, could have the possibility of winning removed solely on the basis of the dealer's hand, and completely outside the player's expectation of winning given the hand the player has been dealt.

Another problem with some prior art three card games is that they include potential automatic winning for all players simply by comparing the players' hands to pay tables. This approach removes the variability and strategy inherent in, for example, comparing hands between the player and dealer, as occurs, for example, with Blackjack. In addition, this approach can be costly to the house or otherwise reduce the likelihood of house winnings, thereby reducing the attractiveness of the game to casinos.

Yet another problem with known three card games is that they typically consist of a single round, such that the play becomes repetitious for players, which can result in loss of interest on the part of players. In addition, because these games typically only include a single round, players have less incentive to play because no other variable game features, such as a different or additional round, occur to provide players with the opportunity to obtain winnings or to offset losses. There is a need for additional rounds to increase the likelihood or incentive for players to play even when losing at the three card game.

Accordingly, there is a need for a three card game that includes more than one round and additional variation and opportunity for players to win than single round poker-like three card games. There is a further need for three card games with rounds that provide for house incentive to offer the game. In particular, there is a need for a game that includes features that provide for variability and strategy with regard to players' opportunities to win, such as by comparing players' hands to a dealer's hand in order to receive the opportunity to win. There is also a need for a game that includes additional features for simple, winning hands for players to provide additional incentive for players to play in more variable, poker-like three hand games.

SUMMARY OF THE INVENTION

It is an advantage of the present invention to meet these needs, and others, by providing a three card game having two rounds to provide increased incentive for play of players and variability and sufficient likelihood of winning for the house.

It is a further advantage of the present invention to provide a simple first round three card game in which each player bets on the likelihood of receiving a third card between two cards initially dealt. It is a further advantage of the first round to provide for payout of one to one for a winning player hand. It is yet a further advantage to provide for the option for each player to place additional bets at odds following receipt of a first card.

It is another advantage of the present invention to provide a second round in which the three cards initially dealt to each player in the first round are compared to a dealer hand. It is yet a further advantage of the present invention to provide a payout in the second round only to player's hands that beat the dealer's hand. It is yet a further advantage to provide a payout in the second round to players based on comparison to a payout table. It is yet a further advantage of the present invention to include no qualifying requirement for the dealer's hand, which increases player incentive to play.

The present invention comprises a casino style three card game and method of playing that includes two optionally playable rounds for each player. The game is playable by one to seven players using one or more standard decks of 52 cards or representations thereof. The game may be played, for example, on a gaming table by players and a dealer using standard cards, or, for example, on a computer or other electronic medium using representations of various features of the game on a display device using a graphical user interface (GUI). The game is also playable in electronic form or in conjunction with electronic features over a network, such as the Internet.

In a first round, two cards are dealt face up to each player electing to play, in turn, and two cards are dealt face down to the dealer. A third card is then dealt face up to each player, and a third card is dealt face down to the dealer. Each player for which the third card has a value between the values of the first two cards wins the first round, receiving a one to one return, for example, on a bet placed, as well as any increased return due to placement of a bet at odds.

Each player elects whether to play in the second round by, for example, placing a second bet after receiving two cards. The second round of play proceeds following completion of the first round. Each player's cards are then compared to the dealer's cards with the high hand winning. If the dealer's hand wins, the player loses, such as by losing the second bet wagered. If the player's hand wins, the house pays the player a return based on a pay table. Betting minimums and maximums, as well as pay table odds, are variably determined depending on mathematical probabilities and preferred odds of winning selected by the house. In play with a gaming table, the table includes various spots or locations for easing play or ensuring proper play, including a location for placement of the third card dealt to each player and betting spots for placement of bets and antes.

In one embodiment, following the ante, in the first round, after dealing the first card face up to each player and the first card face down to the dealer, each player optionally places a "first play" bet with regard to the first round of play. The "first play" bet is placed, for example, on a "first play" spot on a gaming table. This bet optionally includes additional odds, varying with the initial card received. A second card is then dealt face up to each player and face down to the dealer. Each player then either elects to "fold," in which case the player is out of the second round and loses the ante, or to place a "second play" bet for play in the second round of the game. If a player "folds" the second round and placed "no first play" bet, that player is out of the game. A third card is then dealt face up to each player remaining in the game, and a third card is dealt face down to the dealer. For play with a gaming table, the "second play" bet is placed on a "second play" spot on the gaming table, and the third card is placed on an "in between" card spot. The dealer then turns over the dealer's cards. Each remaining player having a third card in between the first two cards is paid, for example, using a one to one return based on the "first play" bet wagered. Each remaining player's hand is then compared to the dealer's hand, in a second round, and winning players are paid using on a pay table based on the amount of each player's ante combined with the wagered "second play" bet. Variations in return paid in the second round, such as by use of odds, are also usable in conjunction with embodiments of the present invention.

To achieve the stated and other advantages of the present invention, as embodied and described below, the invention includes a method for at least one player and a dealer to play a three card game with a standard deck of cards, the game having a first round and a second round, comprising: receiving a selection from each of the at least one player whether to participate in the game; dealing a first card, a second card, and a third card from the deck of cards to each of the at least one player selecting to participate in the game, such that each of the at least one participating player has a player hand of three cards; dealing three cards to the dealer, such that the dealer has a dealer hand of three cards; identifying each of the at least one player winning the first round, wherein identifying each of the at least one player winning the first round includes determining whether the third card is between the first card and the second card for each of the at least one player; after identifying each of the at least one player winning the first round, comparing the hand of each of the at least one player to the dealer hand; and identifying each of the at least one player winning the second round, wherein identifying each of the at least one player winning the second round includes determining whether the hand of each of the at least one player beats the hand of the dealer.

To achieve the stated and other advantages of the present invention, as embodied and described below, the invention further includes a method for playing a three card game with representations of a standard deck of cards, the game having a first round and a second round, comprising: receiving a selection from each player whether to participate in the game; assigning an initial two cards and a third card to each player selecting to participate in the game, such that each player has a player hand of three cards; assigning three cards to the dealer, such that the dealer has a dealer hand of three cards; for each player, determining whether the third card is between the initial two cards, wherein each player having a third card between the initial two cards wins the first round; comparing the hand of each player to the dealer hand; and determining whether the player hand of each player has a higher ranking than the dealer hand, wherein each player for whom the player hand has a higher ranking than the dealer hand wins the second round.

To achieve the stated and other advantages of the present invention, as embodied and described below, the invention further includes a gaming table for at least one player and a dealer to play a three card game with at least one standard deck of cards, the game having a first round and a second round, the gaming table comprising: a table surface; at least one player location indicated on the table surface, each of the at least one player location including: an indicated ante location; an indicated play bet location; and an indicated third card position; and a dealer location indicated on the table surface; wherein a selection is received from each player whether to participate in the game, the selection including placing an ante wager at the indicated ante location; wherein an initial two cards and a third card are dealt from the at least one deck of cards to each player selecting to participate in the game, such that each player has a player hand of three cards, wherein the third card is placed at the indicated third card position; wherein three cards are dealt to the dealer from the at least one deck of cards, such that the dealer has a dealer hand of three cards; wherein, for each player, a determination is made as to whether the third card is between the initial two cards, wherein each player having a third card between the initial two cards wins the first round; wherein a play wager is received from each player selecting to play the second round, wherein the play wager is placed at the indicated play bet location; wherein the hand of each player is compared to the dealer hand; and wherein a determination is made as to whether the player hand of each player has a higher ranking than the dealer hand, wherein each player for whom the player hand has a higher ranking than the dealer hand wins the second round.

To achieve the stated and other advantages of the present invention, as embodied and described below, the invention further includes a device for a player to play a three card game with representations of a standard deck of cards, the game having a first round and a second round, the device comprising: a display for displaying the card game, including the representations of a standard deck of cards; and processor for receiving selections from the player for play of the game, for determining progress of play, and for processing and displaying a graphical user interface; wherein a selection is received from the player whether to participate in the game, the selection including receipt of an ante wager; wherein an initial two cards and a third card are provided for the player, such that the player has a player hand of three cards; wherein the processor determines whether the third card is between the initial two cards, wherein if the third card is between the initial two cards the player wins the first round; wherein a play wager is received from the player, the play wager indicating a selection to play the second round; wherein three cards are provided for the dealer, such that the dealer has a dealer hand of three cards; wherein the player hand is compared to the dealer hand; and wherein the processor determines whether the player hand has a higher ranking than the dealer hand, and wherein if the player hand has a higher ranking than the dealer hand, the player wins the second round.

Additional advantages and novel features of the invention will be set forth in part in the description that follows, and in part will become more apparent to those skilled in the art upon examination of the following or upon learning by practice of the invention.

BRIEF DESCRIPTION OF THE FIGURES

In the drawings:

FIGS. 6A and 6B provide example expected winnings for the "first play" bet and selected possible odds payment for the various first cards received, in accordance with embodiments of the present invention.

DETAILED DESCRIPTION

Figure 1:
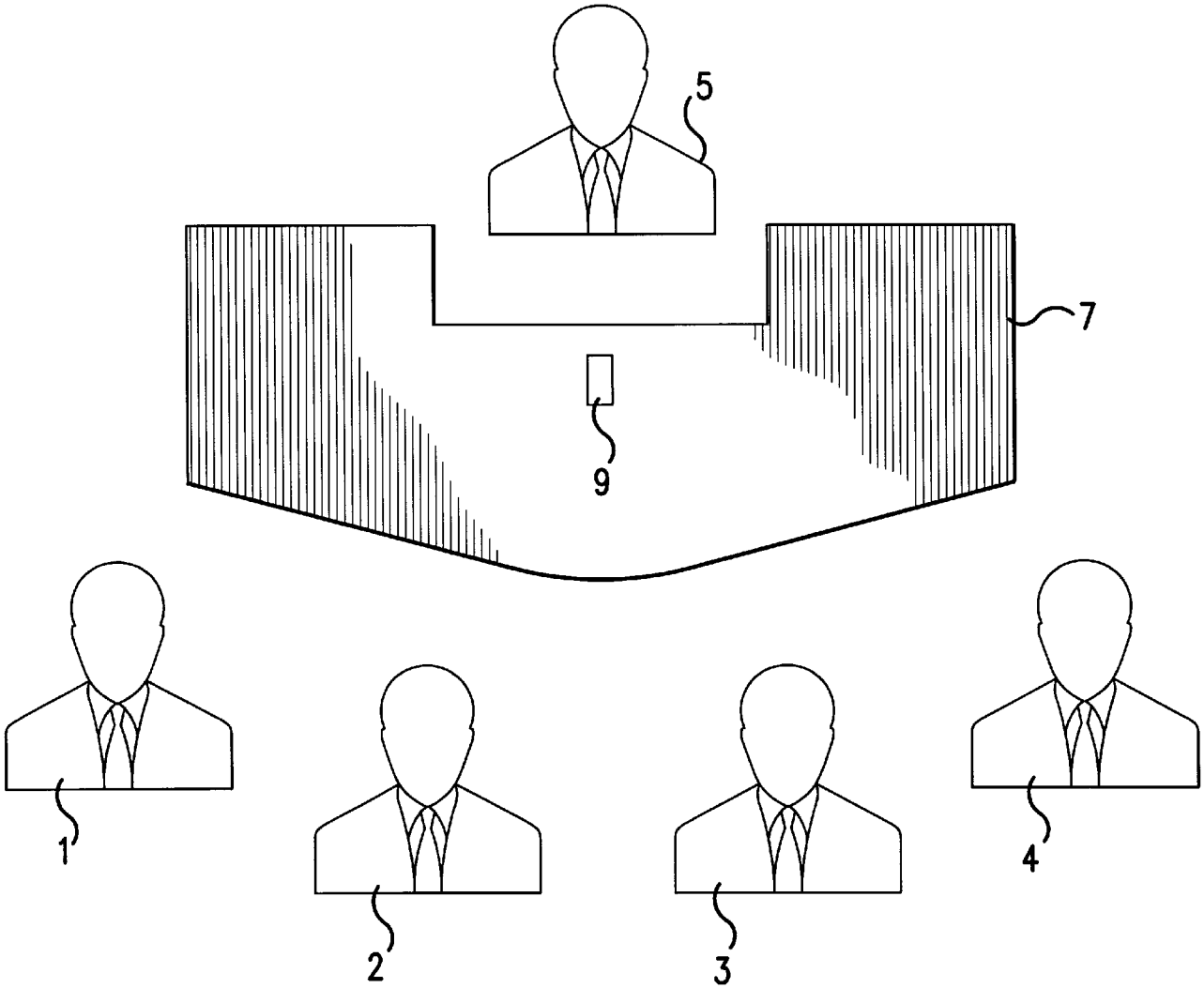
FIG. 1 is an overhead view of the players, dealer, and gaming table for play of the game in accordance one embodiment of the present invention.

An embodiment of the present invention includes two games, referred to as two rounds, that make up the game. The first round is referred to as an "in-between" game, and the second round is a three card poker-style game involving use of a pay table.

In accordance with an embodiment of the present invention, play is conducted using one or more standard sets of 52 playing cards having values of Ace, 2, 3, 4, 5, 6, 7, 8, 9, 10, Jack, Queen, and King. The game may be optionally played with the Ace as the high or low card, or as optionally selectable as high or low by each player. Each participating player is seated at, for example, a playing table, as described further below, on the players' side of the table. The dealer is located on the dealer's side of the table, opposite the players. In one embodiment, the table is curved, having a convex side and an opening for the dealer, so that the dealer is easily able to deal to each player from the dealer opening in the table, and up to seven players are easily and comfortably accommodated on the convex side of the table.

The game may also be played with representations of any of the features described. For example, the game is playable in an electronic or partially electronic manner using a terminal, such as a personal computer, microcomputer, minicomputer, mainframe computer, or other device having a processor and display, such as an electronic hand-held game device, for which representative images of cards are displayable on a screen via a GUI. The game is also playable in conjunction with performance of selected functions on a network, such as the Internet or an intranet.

In the first round of the game, referred to as the "in-between" game, and also referred to as the dealing round, each participating player is first dealt two cards face up and in proximity to each other. To win, the object of this round is for each player to then be dealt a third card having a value falling between the values of the two cards initially dealt. Each player can win in this round by so receiving a third card "inbetween" the first two cards, regardless of whether other players win or lose and regardless of what cards the dealer has been dealt. The round is playable by from one to seven players and includes participation by a dealer.

Before any cards are dealt to begin play of the game, each player decides whether to participate in the game by paying an ante. In an embodiment played in conjunction with use of a gaming table, each player places the ante in an ante spot location for that player. The minimum and maximum bets for the ante are determinable by the rules of the house, or for example, by agreement among the players and the house or dealer.

After each player has determined whether or not to play and all antes have been placed, the dealer cuts the cards or alternatively shuffles and cuts the cards if the game is being played with a single deck of cards. The game is also playable with multiple decks of cards using, for example, a card shoe, in which multiple decks are held and cards are dealt one at a time by removal from the shoe.

Typically, particularly if played with a single deck, the dealer begins by placing the top card to one side as a security measure. Cards are then dealt one at a time face up to each player in turn, such that each player has one card face up. The dealer then deals one card to the dealer face down. In one embodiment, a "first play" bet is then optionally wagered by each player by, for example, placing a wager in the "first play" location on the gaming table. In one embodiment, this bet is made at odds, which vary depending on the first card received. For example, since it is less likely to obtain a card "in between" a middle value card (e.g, 6, 7, 8) and a second card, than to obtaining a card in between a first card having either a very low or very high value and any other second card, one variation of the game includes increased odds for bets placed for these less likely winning first cards.

The process is then repeated so that each player has two cards face up and the dealer has two cards face down. In one embodiment, each player then elects whether to "fold," and thereby not play in the second round, forfeiting the ante, or to place a "second play" bet for participating in the second round. The minimum and maximum bets for "first play" and "second play" are determined by the rules of the house, or for example, by agreement among the players and the house or dealer.

Next, the dealer deals a third card to each player, placing the third card so as to clearly indicate that the third card is the "in-between" card, such as by placing the third card in a specially marked location for each player on the game table, and deals a third card to the dealer face down. The dealer then turns all three dealer cards face up.

Each remaining player who placed a "first play" wager may win the first round, and for each player to win, the third card must fall between the first two cards. For example, if the player were dealt as initial cards a "2" and a "4," the player would win the in-between round if the third card were a "3." No other third card value would allow the player to win in this situation. As another example, if the player were dealt a "6" and a "Jack," in order to win this round, the player would have to receive a "7", "8", "9", or "10".

Each player who wins in the first round is entitled to receive a predetermined amount, such as the equivalent amount to the player's "first play" bet (i.e., each player wins a one to one bet). If the player does not have an "in-between" card, the player loses this round, typically losing that player's "first play" bet to the house. Other winning and losing returns are usable in conjunction with the round without departing from the spirit of the game.

After the first round is completed, each player and the dealer continue to have three cards face up, which are used for play of the second round by those players who placed a "second play" bet. In the second round of the game, each player plays individually against the dealer, and each player can win, regardless of how many players remain, regardless of whether that player won in the first round, and regardless of whether each other player wins or loses in either round. In an embodiment of the present invention, the second part of the game is played with the aforementioned previously dealt cards, in accordance with standard poker rules on high hand, in which each player's hand is compared to the dealer's hand. If the dealer's hand is higher than the player's hand, the player loses and, for example, the player's ante and "second play" bet is lost to the house. If the player's hand is higher than the dealer's hand, the player wins, and, for example, the player receives a variable bet return, which is determined using a pay table based on the combined total of the player's ante and "second play" bet wagered or based solely on the "second play" bet depending on the player's hand.

In an embodiment of the present invention, the dealer's hand includes no "qualifying" feature, such as a minimum hand or required cards (e.g., there is no requirement that the dealer have a Jack or better or Ace or better in order to play against the players). This lack of qualifying hand for the dealer is important in that the players' incentive to play is increased because potentially winning hands, as well as corresponding potentially winning bets, cannot be disqualified simply by lack of a hand on the dealer's part.

An embodiment of the present invention includes payout by a pay table to players having winning hands in the second round of the game. With the use of a pay table, a variable ratio payback is paid to each player depending on the player's hand. For example, in one embodiment, the pay table includes varying returns for winning player's hands for three of a kind, a straight, a flush, a straight flush, and a royal flush, consisting of a Queen, King, and Ace of the same suit. These returns may include, for example, one and a half to one, two to one, or three to one or greater paybacks, depending on the hand. In an embodiment of the present invention, all other winning hands, for example, would be subject to a one to one return. In one embodiment, no return is paid on the ante if the player does not have at least a pair, and the ante is carried over to the next round (i.e., the ante is a "push"). In an embodiment of the present invention, the returns in the pay table are determined using a mathematical formula to assure a predetermined likelihood of house returns.

No return, however, is paid to players having losing hands versus the dealer, regardless of the pay table payout indicated; only winning hands versus the dealer are paid. Providing payment only upon a hand beating the dealer hand provides an advantage over the prior art by increasing player incentive to play through use of strategy, while also increasing variability in house winnings over games having preset winning hands without the dealer and player comparison feature.

The game table used conjunction with an embodiment of the present invention is a standard blackjack or poker sized casino table, in which a dealer occupies one side of the table and players occupy the other. In one embodiment, the table includes a bar located on the dealer's side of the table. The table also includes the name of the game, "The In-Between Game" or "2 Play Poker."

From the player's side, below the name (toward the players), are player positions for up to seven player spots. At each player's position are three betting spots or areas, one of which is marked "ante" and the other two marked "first play" and "second play." At these betting spots, players place chips for betting as play of the game proceeds. In an embodiment of the present invention, the ante spot is used to indicate selection to play in the game, the "first play" spot is used as an optional bet spot for potential return in the first round of the game, and the "second play" spot is used for betting with respect to the second round of the game. Because the "first play" and "second play" spots are used as play proceeds, in order to reduce the likelihood or confusion or cheating by players, the "first play" and "second play" spots are located adjacent to each other and toward the player on the table, so that the player's placement of a bets on these spots during the course of the game does not require the player to obstruct the ante spot, as viewed by the dealer. Near the betting spots are locations for placing one card for each player (a card spot) of an appropriate size and shape for placing a single standard size playing card.

During the play of the game, selected cards are dealt by the dealer to each player by placing the card on the card spot. In particular, in the "in-between game" round of the game, in accordance with one embodiment of the present invention, two cards are first dealt to each player, with neither card being dealt to the card spot. A third card is then dealt to each player by placing the card in the card spot. In order to win this round of the game, in accordance with an embodiment of the present invention, the third card (the "in-between card"), placed in the card spot, must have a value between the values of the two previously dealt cards for that player. The placement of the third card in the card spot clearly delineates to both the dealer and the players which card must fall between the other two. The table may optionally also include card spots for placement of the first two cards dealt. Any spots on the table for these cards must be clearly delineated from the card spot for the in-between card.

In an embodiment of the present invention, marked lines, such as red or red and white lines, are included on the table to clearly delineate each player's position from an adjacent player or players. The clear separation of each player position by the lines serves a number of functions, including preventing cheating, by clearly indicating the area in which a player's money or chips are located.

References will now be made in detail to embodiments of the present invention, examples of which are illustrated in the accompanying drawings.

FIG. 1 is an overhead view of the players, dealer, and gaming table for play of the game in accordance one embodiment of the present invention. FIG. 1 shows an embodiment of the game as played with one to seven players 1, 2, 3, 4 and a dealer 5 at a gaming table 7 using one or more decks of cards located at a card location 9.

Figure 2:
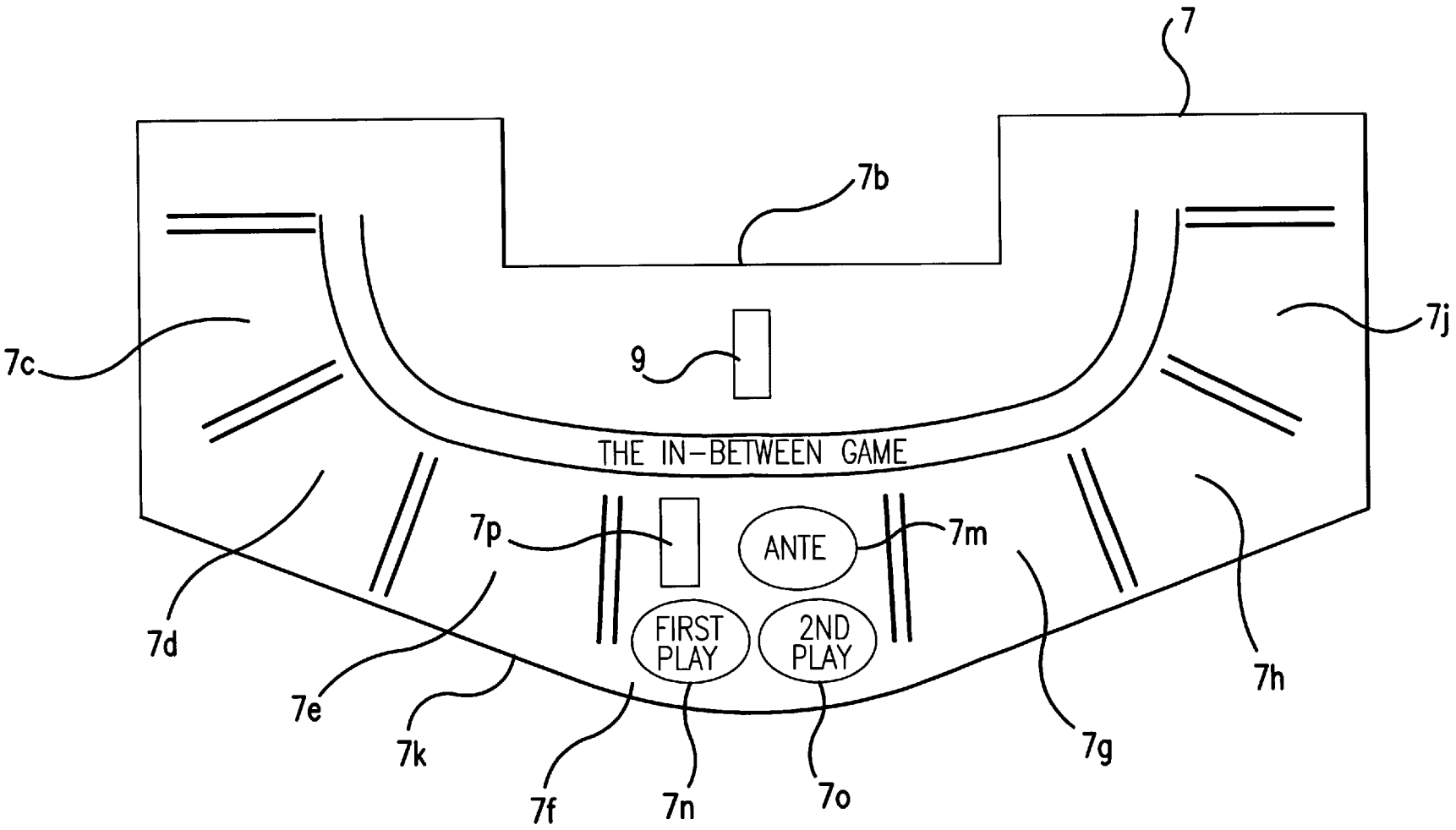
FIG. 2 presents a gaming table layout for a gaming table in accordance with an embodiment of the present invention.

FIG. 2 presents a gaming table layout for a gaming table in accordance with the embodiment of the present invention for play by players and a dealer at a gaming table. As shown in FIG. 2, the table 7 includes a deck placement area 9 on the dealer side of the table 7*b* and seven player areas 7*c*, 7*d*, 7*e*, 7*f*, 7*g*, 7*h*, 7*j* on the players' side of the table 7*k*. Each player area 7*c*, 7*d*, 7*e*, 7*f*, 7*g*, 7*h*, 7*j* includes three marked areas, an ante spot 7*m*, for placement of an ante wager, a first play spot 7*n*, for placement of a first play wager, a second play spot 7*o* for placement of a second play wager, and an in-between card spot 7*p* for placement of the third or in-between card received by each player during play of the first round of the game.

Figure 3:
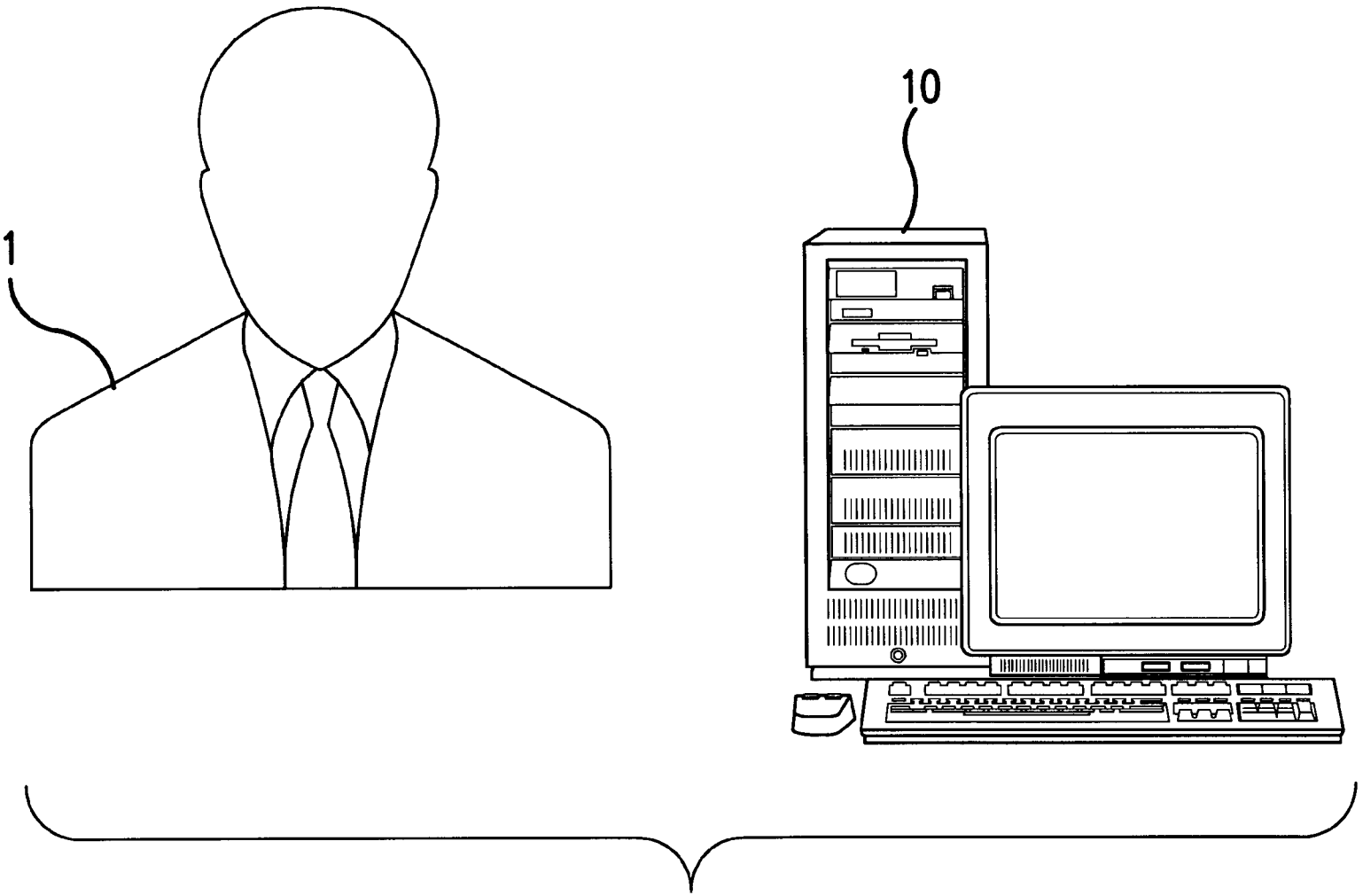
FIG. 3 depicts the components for electronic play of the game in accordance with one embodiment of the present invention.

FIG. 3 depicts the components for electronic play of the game in accordance with one embodiment of the present invention. As shown in FIG. 3, in this embodiment, the player 1 plays at a terminal 10, such as a personal computer, a minicomputer, a microcomputer, a main frame computer, or other device having a display, processor, and GUI, including a hand-held electronic game.

Figure 4:
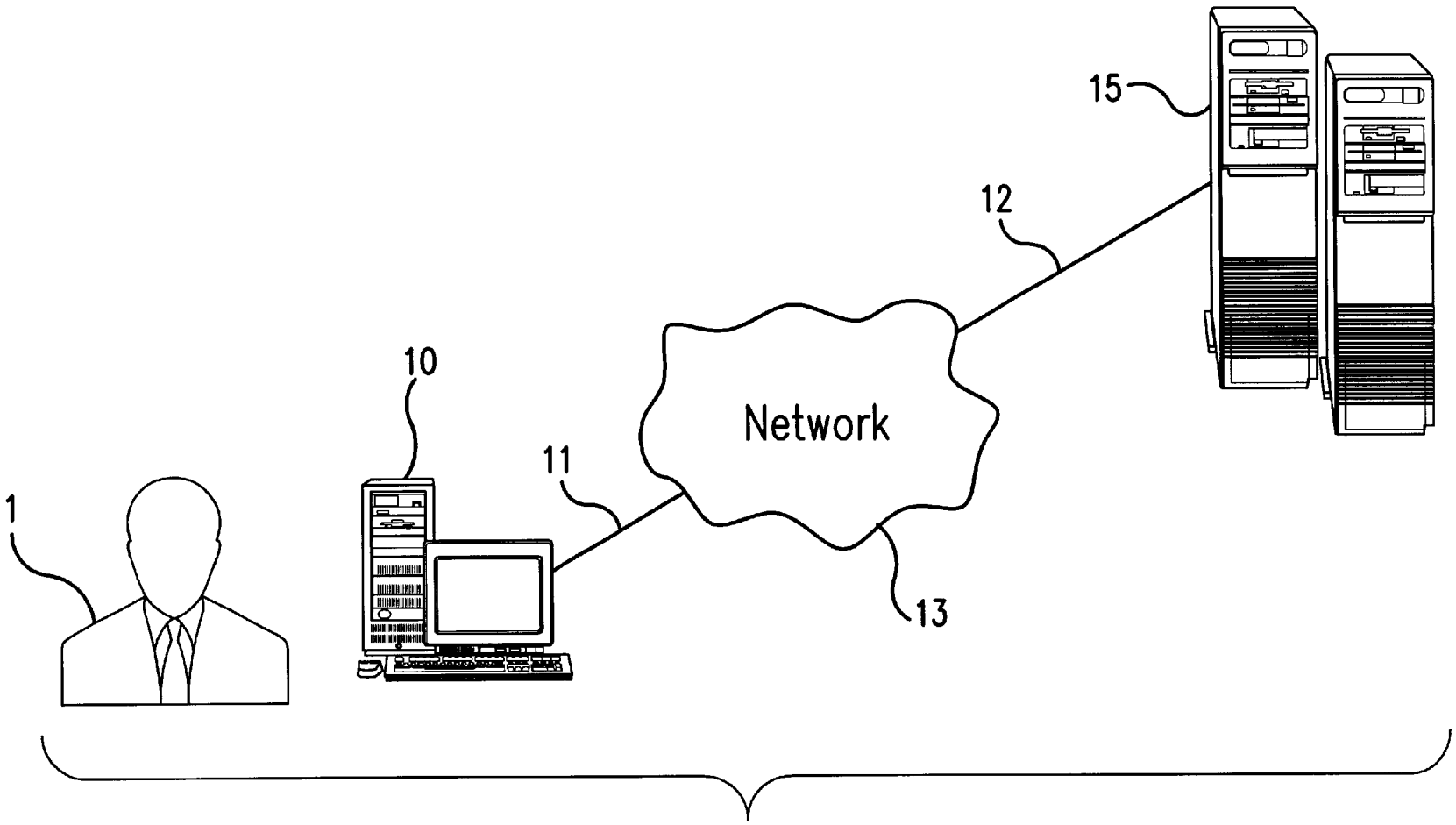
FIG. 4 presents components for electronic play of the game using a network in accordance with another embodiment of the present invention.

FIG. 4 presents components for electronic play of the game using a network, such as the Internet or an intranet, in accordance with another embodiment of the present invention. As shown in FIG. 4, a player 1 plays at a terminal 10, such as a personal computer, a minicomputer, a microcomputer, a main frame computer, or other device having a display and processor. The terminal 10, is connected 11, 12 via, for example, wire, wireless, or fiberoptic coupling to a network 13, such as the Internet or an intranet, to a server 15, such as personal computer, a minicomputer, a microcomputer, a main frame computer, or other device having a processor.

Figure 5A:
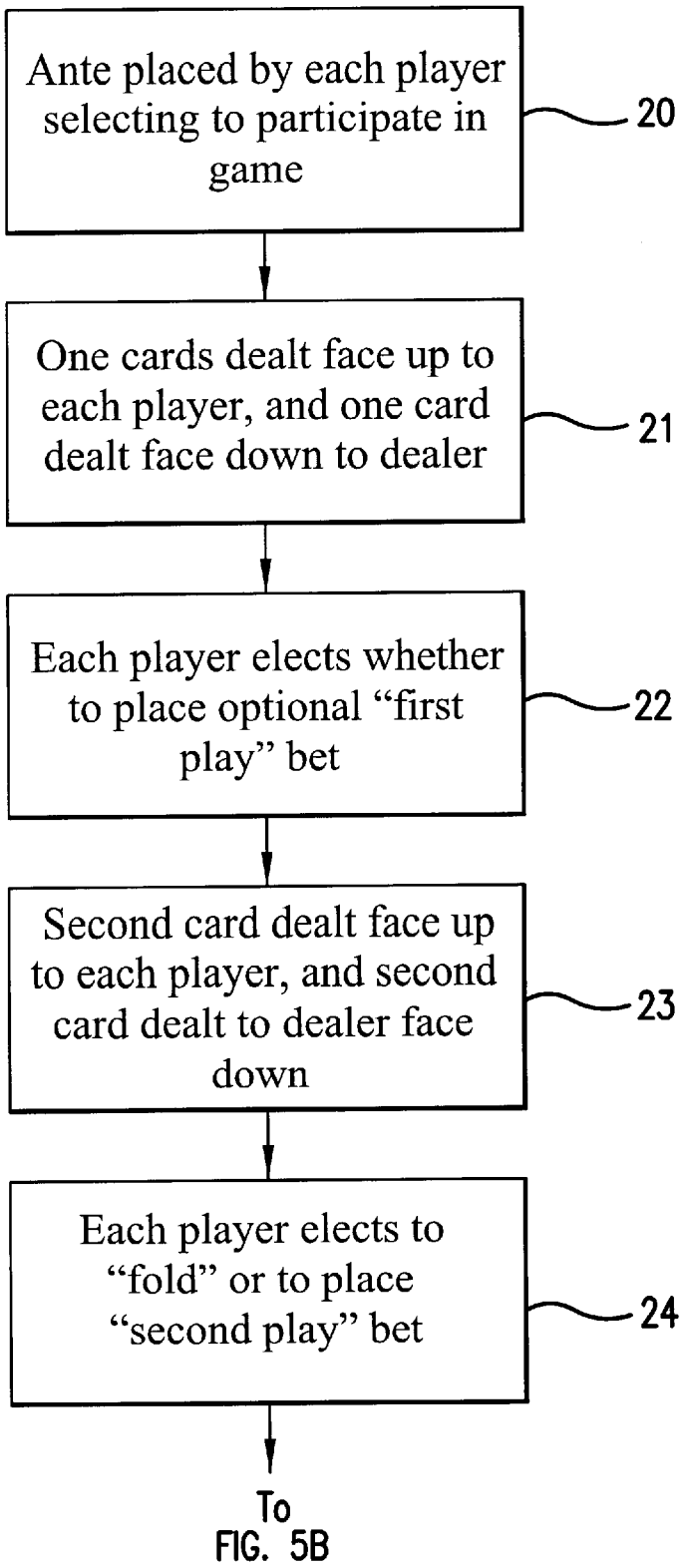
FIGS. 5A–5C show a flow diagram of an example method of play in accordance with an embodiment of the present invention.
Figure 5B:
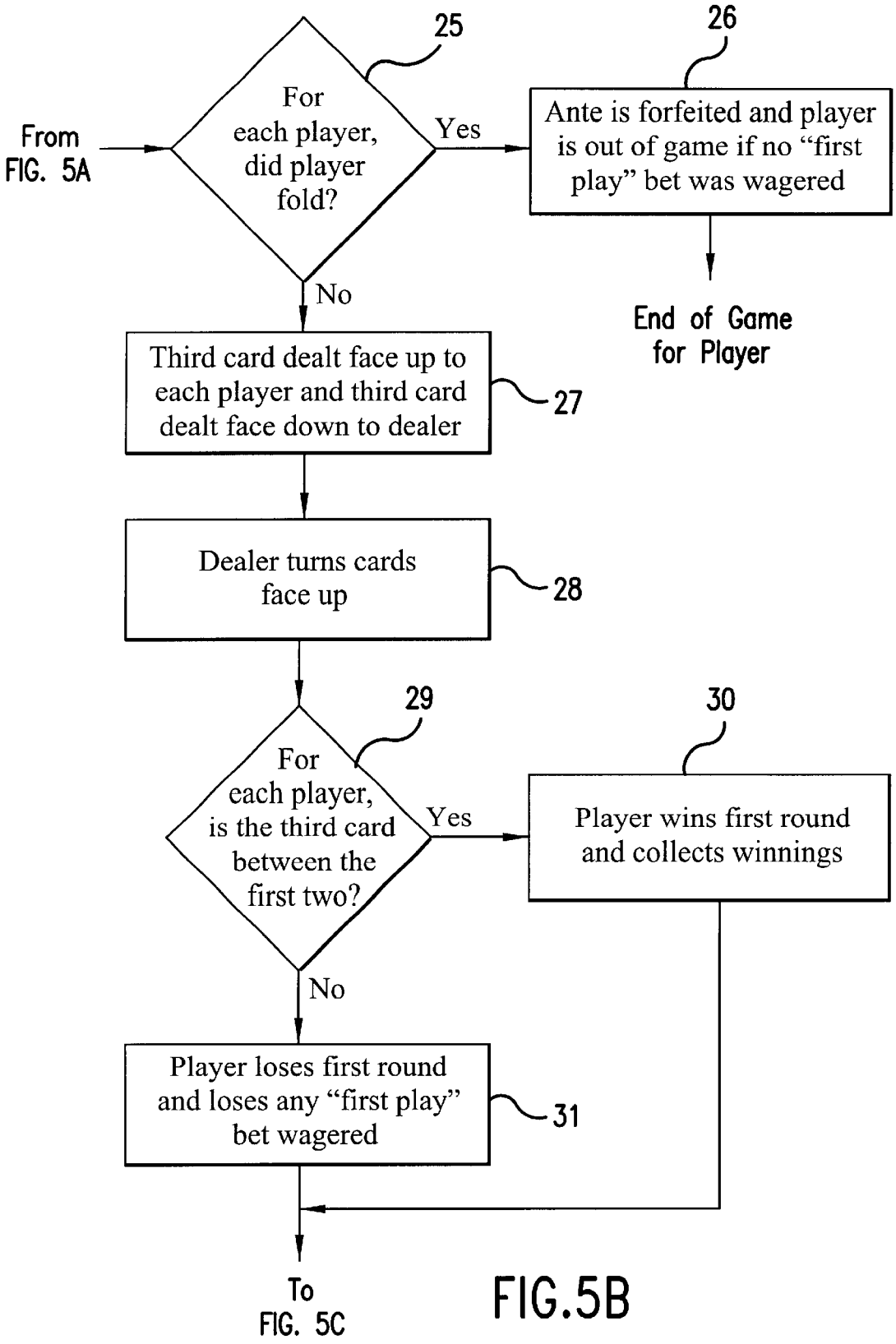
Figure 5C:
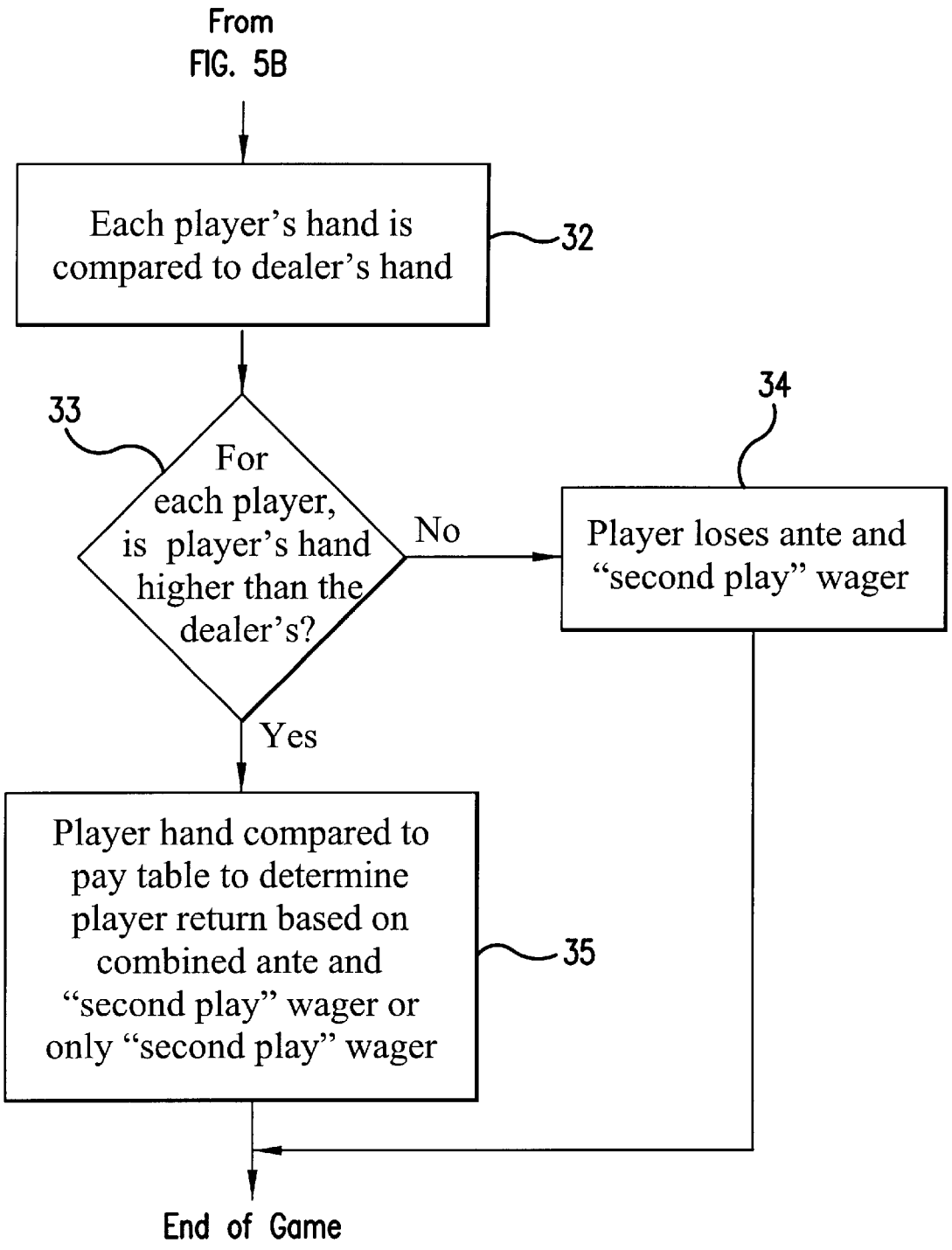

FIGS. 5A–5C show a flow diagram of an example method of play in accordance with an embodiment of the present invention. As shown in FIG. 5A, play of the game begins with an ante placed by each player selecting to participate in the game 20. The ante can be placed, for example, by the player positioning a wager in the ante area for that player on a gaming table or, for example, by selecting an option on a terminal. A first card is then dealt face up to each player, and one card is dealt face down to the dealer 21. Next, each player elects whether to place an optional "first play" bet 22, which is also optionally made at odds. A second card is then dealt face up to each player, and a second card is dealt face down to the dealer 23. Each player then elects whether to "fold" or to place a "second play" bet for participation in the second round of the game 24.

As shown in FIG. 5B, a determination is then made as to whether each player folded 25. For each player electing to fold, the ante is forfeited to, for example, the house 26, and play of the game ends for that player if the player did not place any "first play" wager. The third card is dealt face up to each remaining player, and a third card is dealt face down to the dealer 27. The dealer then turns the dealer cards face up 28. For each player, a determination is then made as to whether that player has received a third card in between the first two cards 29. If the third card is in between the first two cards, the player wins the first round and collects winnings, such as a one to one return on the "first play" bet wagered 30. If the third card is not in between the first two cards, the player loses the first round, losing, for example, the "first play" bet wagered 31. This ends the first round play.

Play of the second round then begins. As shown in FIG. 5C, play of the second round begins by comparing each player's hand individually to the dealer's hand 32. For each player, a determination is made as to whether the player's hand is higher than the dealer's hand 33. For example, determination of the higher hand is conductible in accordance to the value of hands determined in accordance with the rules of poker. If the dealer's hand is higher than the player's hand, the player loses the second round and loses the ante and the "second play" bet wagered 34. If the player's hand is higher than the dealer's hand, the player wins, and the player's hand is compared to a pay table to determine the player return based on the combined ante and "second play" bet wagered or based only on the "second play" bet if the player does not have at least one pair 35. For example, if the player has three of a kind, a straight, a flush, or a straight flush, the player's return may be variably greater than one to one, depending on the hand, while if the player does not have one of these hands, the player return may be one to one. The return is made, for example, by payment from the house.

FIGS. 6A and 6B provide example expected winnings for the "first play" bet and selected possible odds payment for the various first cards received, in accordance with embodiments of the present invention. FIG. 6A presents example odds for use with an Ace optionally played as either a high card or a low card. FIG. 6B presents example odds for use with an Ace played as a high card only.

Example embodiments of the present invention have now been described in accordance with the above advantages. It will be appreciated that these examples are merely illustrative of the invention. Many variations and modifications will be apparent to those skilled in the art.

What is claimed is:

1. A method for at least one player and a dealer to play a three card game with a standard deck of cards, the game having a first round and a second round, comprising:

dealing a first card to each of the at least one player;

following dealing the first card, receiving a selection from each of the at least one player whether to participate in the first round;

dealing a second card to each player;

following dealing the second card, receiving a selection from each of the at least one player whether to participate in the second round;

dealing a third card to each of the at least one player selecting to participate in either the first round or the second round, such that each of the at least one participating player has a player hand of three cards;

dealing three cards to the dealer, such that the dealer has a dealer hand of three cards;

identifying each of the at least one player winning the first round, wherein identifying each of the at least one player winning the first round includes determining whether the third card is between the first card and the second card for each of the at least one player;

after identifying each of the at least one player winning the first round, comparing the hand of each of the at least one player to the dealer hand; and identifying each of the at least one player winning the second round, wherein identifying each of the at least one player winning the second round includes determining whether the hand of each of the at least one player beats the hand of the dealer.

2. The method of claim 1, wherein receiving a selection from each of the at least one player whether to participate in the first round comprises receiving an ante.

3. The method of claim 2, further comprising:

receiving a selection of whether to fold from each of the at least one player; and taking the ante from each of the at least one player selecting to fold.

4. The method of claim 1, further comprising:

receiving a selection from each of the at least one player whether to wager in the first round.

5. The method of claim 4, wherein the selection from each of the at least one player whether to wager in the first round comprises receiving a first play bet.

6. The method of claim 5, further comprising:

for each of the at least one player winning the first round, paying the player a one to one return for the first play bet.

7. The method of claim 5, further comprising:

for each of the at least one player not winning the first round, taking from the player the first play bet.

8. The method of claim 4, wherein the selection from each of the at least one player whether to wager in the first round comprises receiving a bet at odds, and wherein the bet at odds varies with the first card dealt.

9. The method of claim 1, further comprising:

receiving a selection from each of the at least one player whether to wager in the second round.

10. The method of claim 9, wherein the selection from each of the at least one player whether to wager in the second round comprises receiving a second play bet.

11. The method of claim 10, wherein determining whether the hand of each of the at least one player beats the hand of the dealer includes determining whether each of the at least one player hands has a higher ranking than the dealer hand.

12. The method of claim 11, wherein the higher ranking is determined in accordance with standard ranking of poker hands.

13. The method of claim 11, further comprising:

if the dealer hand has a higher ranking than the player hand, taking from the at least one player the ante and the second play bet.

14. The method of claim 11, further comprising:

if the player hand has a higher ranking than the dealer hand, comparing the player hand to a predetermined ranking.

15. The method of claim 14, wherein comparing the player hand to a predetermined ranking includes comparing the player hand to a pay table.

16. The method of claim 14, wherein the predetermined ranking includes at least one selected from a group consisting of three of a kind, a straight, a flush, a straight flush, and a royal flush.

17. The method of claim 14, wherein if the player hand is less than the predetermined ranking, paying the player at one to one for the second play bet.

18. The method of claim 1, wherein the dealer hand is initially dealt face down.

19. The method of claim 1, further comprising the dealer turning each card in the dealer hand face up.

20. A method for playing a three card game with representations of a standard deck of cards, the game having a first round and a second round, comprising:

assigning a first card to each of the at least one player;

following assigning of the first card, receiving a selection from each of the at least one player whether to participate in the first round;

assigning a second card to each player;

following assigning of the second card, receiving a selection from each of the at least one player whether to participate in the second round;

assigning a third card to each of the at least one player selecting to participate in either the first round or the second round, such that each of the at least one participating player has a player hand of three cards;

assigning three cards to the dealer, such that the dealer has a dealer hand of three cards;

for each player, determining whether the third card is between the initial two cards, wherein each player having a third card between the initial two cards wins the first round;

comparing the hand of each player to the dealer hand; and determining whether the player hand of each player has a higher ranking than the dealer hand, wherein each player for whom the player hand has a higher ranking than the dealer hand wins the second round.

* * * * *